US005242123A

United States Patent [19]

Parham

[11] Patent Number: 5,242,123

[45] Date of Patent: Sep. 7, 1993

[54] CAST PLUNGER CAN AND SPRING COMPRESSOR

[76] Inventor: Robert L. Parham, 1675 Larimer St., Ste. 625, Denver, Colo. 80202

[21] Appl. No.: 694,965

[22] Filed: May 20, 1991

[51] Int. Cl.[5] ..... B02C 25/00

[52] U.S. Cl. ..... 241/37.5; 241/121; 241/289

[58] Field of Search ..... 241/37.5, 117-121, 241/287-290; 267/89, 136, 137, 170, 172, 174-177, 179

[56] References Cited

U.S. PATENT DOCUMENTS

| | | | |
|---|---|---|---|
| 3,730,446 | 5/1973 | Piepho | 241/118 X |
| 3,881,348 | 5/1975 | Morton | 241/121 X |
| 4,382,561 | 5/1983 | Andersen et al. | 241/290 X |
| 4,465,240 | 8/1984 | Bacharach | 241/290 X |
| 4,491,280 | 1/1985 | Bacharach et al. | 241/285.1 X |
| 4,522,343 | 6/1985 | Williams | 241/110 X |
| 4,620,674 | 11/1986 | Hanstne et al. | 241/289 X |
| 4,679,739 | 7/1987 | Hashimoto et al. | 241/121 |
| 4,694,994 | 9/1987 | Henne et al. | 241/119 X |
| 4,705,223 | 11/1987 | Dibowski et al. | 241/121 X |
| 4,706,900 | 11/1987 | Prairie et al. | 241/121 |
| 4,717,082 | 1/1988 | Guido et al. | 241/121 |
| 4,759,509 | 7/1988 | Prairie | 241/121 |
| 4,996,757 | 3/1991 | Parham | 241/291 X |
| 5,050,810 | 9/1991 | Parham | 241/117 X |
| 5,067,662 | 11/1991 | Chang | 241/119 X |
| 5,079,819 | 1/1992 | Parham | 241/291 X |

*Primary Examiner*—Mark Rosenbaum
*Assistant Examiner*—Frances Chin
*Attorney, Agent, or Firm*—Beaton & Swanson

[57] ABSTRACT

A substantially one-piece cast plunger can structure and a mated spring compressor system. The plunger can includes a removable plunger bearing on one end that is attached to the plunger can with both interlocking lugs and bolts and is designed for removal with a spring compressor that holds it in place.

3 Claims, 5 Drawing Sheets

CAST PLUNGER CAN AND SPRING COMPRESSOR

BACKGROUND OF THE INVENTION

This invention pertains to pulverizing mills, and more particularly to the plunger can structures which contain mechanical spring suspension systems used in such mills, and to spring compressor systems which easily and safely open and close such plunger cans.

Pulverizing mills are used to pulverize coal, limestone and other solid materials. In the case of coal, gravel sized coal enters the mill and is pulverized into a powder. The powder is carried out of the pulverizer by a high velocity air stream and into a furnace where it explosively burns to heat steam which, in an electrical power generator, drives a turbine to generate electricity. The pulverizers are designed to operate continuously, except during periods of repair. Examples of these kinds of coal pulverizers are in U.S. Pat. No. 4,705,223 by Dibowski et al.; U.S. Pat. No. 4,694,994 by Henne et al.; U.S. Pat. No. 4,679,739 by Hashimoto et al.; U.S. Pat. No. 4,522,343 by Williams; U.S. Pat. No. 4,491,280 by Bacharach; and U.S. Pat. No. 4,717,082 by Guido et al.

The pulverizing is accomplished by directing the coal onto grinding tables which interface with pulverizing rollers. The rollers are each mounted on a separate roller assembly shaft, and each roller assembly shaft is mounted on a clamshell door in the pulverizer. Typically, the grinding table is a disc-shaped member with an annular groove or raised circumferential edge in the top surface. The grinding table rotates so that the annular groove mates with the rollers. The coal is introduced from the top of the assembly and feeds by gravity to the annular groove where it is pulverized as the grinding table rotates under the rollers. The pulverized coal dust is discharged from the grinding table by a high velocity air flow deflected over the grinding table. The coal dust is redirected through and out of the pulverizing mill by subsequent deflection of the combined flow of air and suspended coal dust particles.

The pulverizing mill may use a rotating grinding table with stationary roller assemblies, as described in U.S. Pat. No. 4,717,082 by Guido et al. (the contents of which are hereby incorporated by reference), and additional examples of these kinds of roller assemblies are in U.S. patent application Nos. 07/464,870 filed Jan. 16, 1990 by Parham and U.S. Pat. No. 07/539,574 filed Jun. 18, 1990 by Parham. Alternatively, the pulverizing mill may use a stationary grinding table and several rotating roller assemblies. The roller assemblies may also be independently biased against the grinding table so that vibration and shock on one roller will not be transferred to all the other rollers, as described in the Guido patent. The rollers and grinding table are massive; each roller weighs several tons and is on the order of five feet in diameter.

The roller assemblies are biased towards the grinding table by means of compression spring assemblies. Because of the large size of present pulverizing mills and grinding rollers, compression spring assemblies exerting forces within the range of 25,000 to 30,000 PSI are common. Those compression spring assemblies typically are housed in a plunger can structure (sometimes referred to in the art also as a "Journal Spring Housing" or "Spring Housing" as a constituent part of a "Mechanical Spring System") which is suitably mounted so as to cooperate with the roller assembly. A typical plunger can structure houses several elements, including a compression spring assembly, a plunger assembly which transfers the force generated by the compression spring to the roller element of the roller assembly, and a plunger bearing assembly, all of which are well known in the art (the plunger assembly is sometimes referred to in the art as a "Stud Assembly" or "Preload Stud Assembly"). Examples of these kinds of plunger can structures and the assemblies housed therein are in U.S. Pat. Nos. 3,881,348 by Morton, U.S. Pat. No. 4,706,900 by Prairie, et al. and U.S. Pat. No. 4,759,509 by Prairie.

The plunger can structure currently in standard use is a fabricated can comprising a multiplicity of parts. Each of the assemblies housed within the can also comprises a multiplicity of parts. Between the plunger can and the assemblies housed within it, and among the several assemblies, are bushings, bearings and other fittings by which the interfacing elements of each assembly suitably come into contact with, or mutually support and hold in place, interfacing elements of the other assemblies and the plunger can structure. These interfacing elements comprise a further multiplicity of parts.

The plunger can structure itself as well as the compression spring assembly, the plunger assembly, the plunger bearing assembly, and all of the interfacing and other elements of each assembly contained within the plunger can are exposed to extreme conditions. The massive roller assemblies with which they cooperate typically revolve at 200 to 300 revolutions per minute. The pulverizing mills within which many of the plunger cans are installed operate at a temperature around 600 to 700 degrees F. In addition, the mills occasionally catch fire. Such fires are frequently smothered with steam and then cooled, resulting in large and fast temperature changes in the pulverizing mills. There is also the constant presence of pulverized coal dust particles throughout the pulverizing mills. Carried by high speed air flow, the coal particles in motion create the effect of a continuous sand-blasting on all component structures within the interior of the pulverizing mill.

The existing multi-part fabricated can, cooperating with its several multi-part assemblies and interfacing elements under the extreme conditions of the pulverizing mill, is a source of a number of costly problems. These problems affect both the fabricated plunger can structure and the assemblies it houses. One problem is that the fabricated plunger can wears out or one or more of the multiplicity of parts comprising it wears out. Such wear in the fabricated plunger can is a product of vibration, abrasion and shock, and is accentuated by differential shrinkage and expansion of its various elements in reaction to heating and cooling in the pulverizing mill. Stress cracks and fractures are not uncommon in the fabricated plunger can structure. So also, and by similar causes, the compression spring assembly, plunger assembly, plunger bearing assembly and interfacing elements contained within the fabricated plunger can structure experience structural degradation, deterioration misalignment and wear. Other degradation to the assemblies is caused by the cumulative blasting effect, deposit over time, and consequent caking of, coal dust particles around the elements of such assemblies.

Repairing the existing fabricated plunger can structures themselves, and opening them so as to inspect, clean, adjust, or repair or replace the compression spring assembly, plunger assembly, plunger bearing assembly and interfacing elements contained within them presents other difficulties. The compression spring in the plunger can may be under twenty thousand pounds or more of pressure, so that the top tends to explode off the can like a bomb when it is removed, thereby endangering the workmen and surroundings. Also, the existing fabricated plunger can structures must be removed from the pulverizing mill for opening off site. This requires labor and takes time. The pulverizing mill cannot operate during that time, and the down time imposes a cost of many thousands of dollars per day. Electric utilities seek to pass that cost on to rate payers or else absorb it so as to suffer diminished rates of return to their shareholders.

Moreover, wear and degradation to the plunger can structure and to the assemblies housed within it adversely affect the massive roller assemblies of the pulverizing mill. In particular, the wear rate of the roller assemblies is sensitive, not only to the depth, hardness and uniform size and consistency of the coal, but also to the amount and uniformity of the countervailing force applied to the rollers by the compression spring and other assemblies housed within the plunger can structure. The cost of repairing or replacing the rollers is very high in relation to the cost of repairing or replacing the plunger can structures and any of the assemblies contained therein.

Plunger can structures may be mounted so as to be located almost completely externally to the interior chamber of the pulverizing mill, as shown in the Prairie patents referenced previously, including U.S. Pat. No. 4,706,900 by Prairie et al. Although can structures so mounted may thereby lessen the exposure of the plunger can to the extreme conditions existing within the mill, they are inherently more dangerous to the workmen and surroundings because they lack the protective shielding of the mill as in an internally mounted plunger can. Also, none of the existing devices described in the patents recited above or elsewhere adequately addresses the problem of improving the plunger can structure itself so as to better withstand those extreme conditions. Further, none of the existing devices described in the patents recited above or elsewhere adequately addresses the problem of providing a spring compressor system that easily and safely opens the plunger can in place to permit the inspection, repair, adjustment or replacement of the compression spring assembly, plunger assembly, plunger bearing assembly and interfacing elements contained within the plunger can. Finally, none of the existing devices described in the patents above or elsewhere allow the plunger can to be adapted specially to the unique operating characteristics of the pulverizing mill in which it will be mounted.

SUMMARY OF THE INVENTION

The present invention is a cast plunger can structure and mated spring compressor system. The cast plunger can structure uses fewer parts than existing fabricated plunger cans. As a result, the cast plunger can eliminates the need for many replaceable parts compared to existing fabricated plunger cans, thereby increasing the life of the cast plunger can and decreasing its associated maintenance costs. The cast plunger can further extends the useful life of the plunger can structure by improving its tensile strength compared to existing fabricated plunger cans. The cast plunger can and associated plunger guide also include a lengthened bearing surface within the plunger can structure which increases the stability that the plunger can affords to the plunger assembly contained therein so as to eliminate premature wear of the plunger tip. The mated spring compressor system easily and safely opens and closes the cast plunger can without the necessity of removing the can from the pulverizing mill.

DETAILED DESCRIPTION OF THE PREFERRED EMBODIMENT

Figure 1:
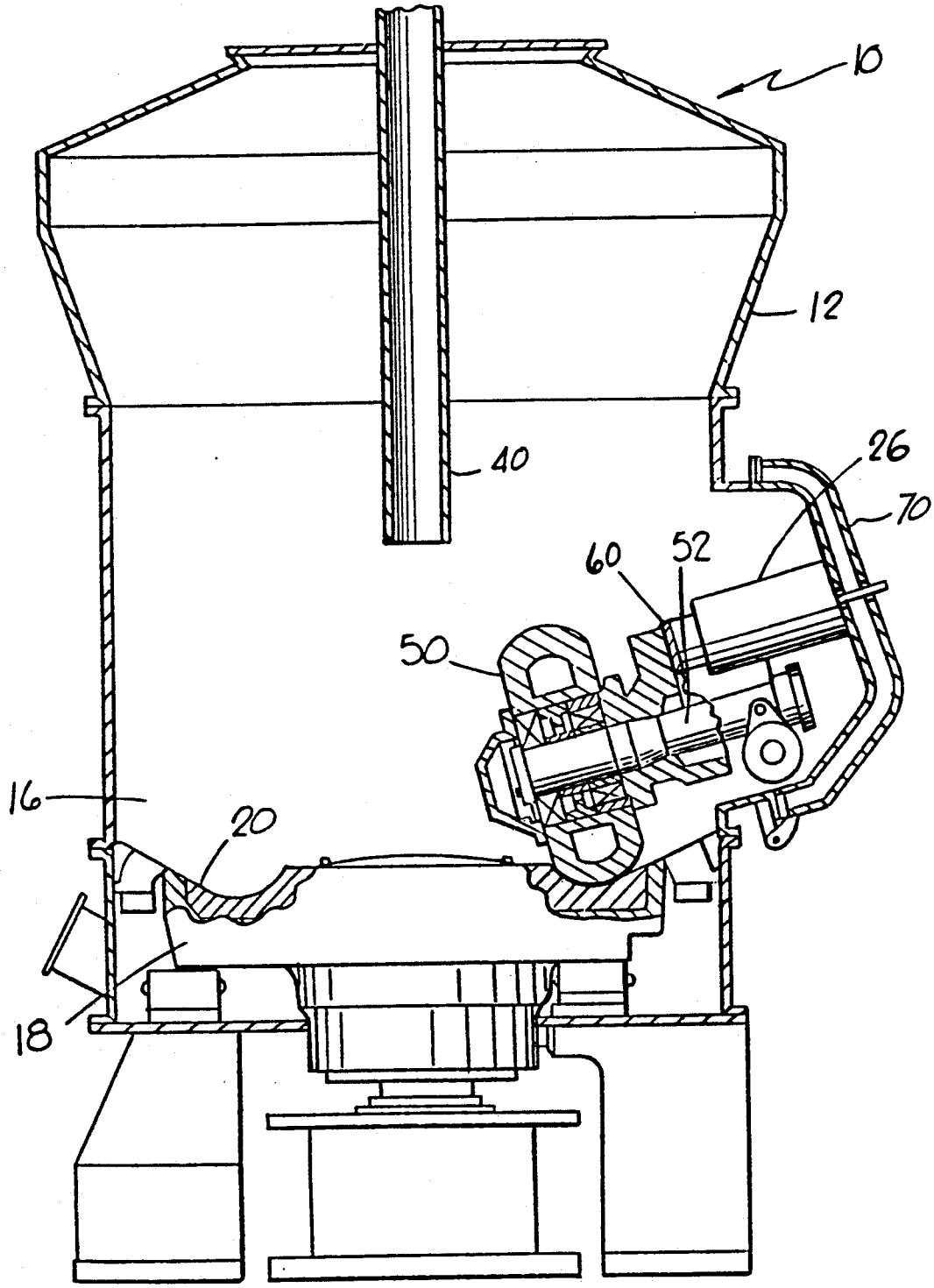
FIG. 1 shows a side view, partially in section, of a typical pulverizer mill in which the present invention may be used.

FIG. 1 shows a typical coal pulverizer mill 10 which is well known in the art. The pulverizer 10 has an outer housing 12 including an upper portion 14 and a lower pulverizing area 16. In the lower pulverizing area 16, there is a grinding table 18 with an annular groove 20 on the upper surface. A set of three roller assemblies 50 (one shown) mate with an annular groove 20 in the upper surface of the grinding table 18. Each of the roller assemblies 50 rotates on the end of its own roller assembly shaft 52. Each roller assembly 50 has a plunger can structure 26 cooperatively associated with it. Each of the plunger can structures 26 houses several assemblies yet to be described which are operative to establish a mechanical spring suspension system working on the associated roller assembly 50. Each plunger can structure 26 is joined to a separate clamshell door 70 in the housing 12 to which its associated roller assembly 50 is joined.

Unpulverized coal up to about two inches in diameter is introduced into the pulverizer through a coal pipe 40 in the pulverizer upper portion 14. The coal falls downward onto the grinding table 18 and into the annular groove 20. The grinding table rotates so that the annular groove 20 passes under the roller assemblies 50. The roller assemblies 50 are biased towards the annular groove 20 by operation of the plunger can structures 26. The roller assemblies may be driven independently by suitable motors (not shown). The present invention would be equally applicable to a pulverizing mill in which the roller assemblies turn around a center housing and the grinding table is stationary.

A more detailed description of the nature of the construction and mode of operation of the pulverizing mill 10 is contained in the Guido and Prairie patents previously referenced.

Figure 2:
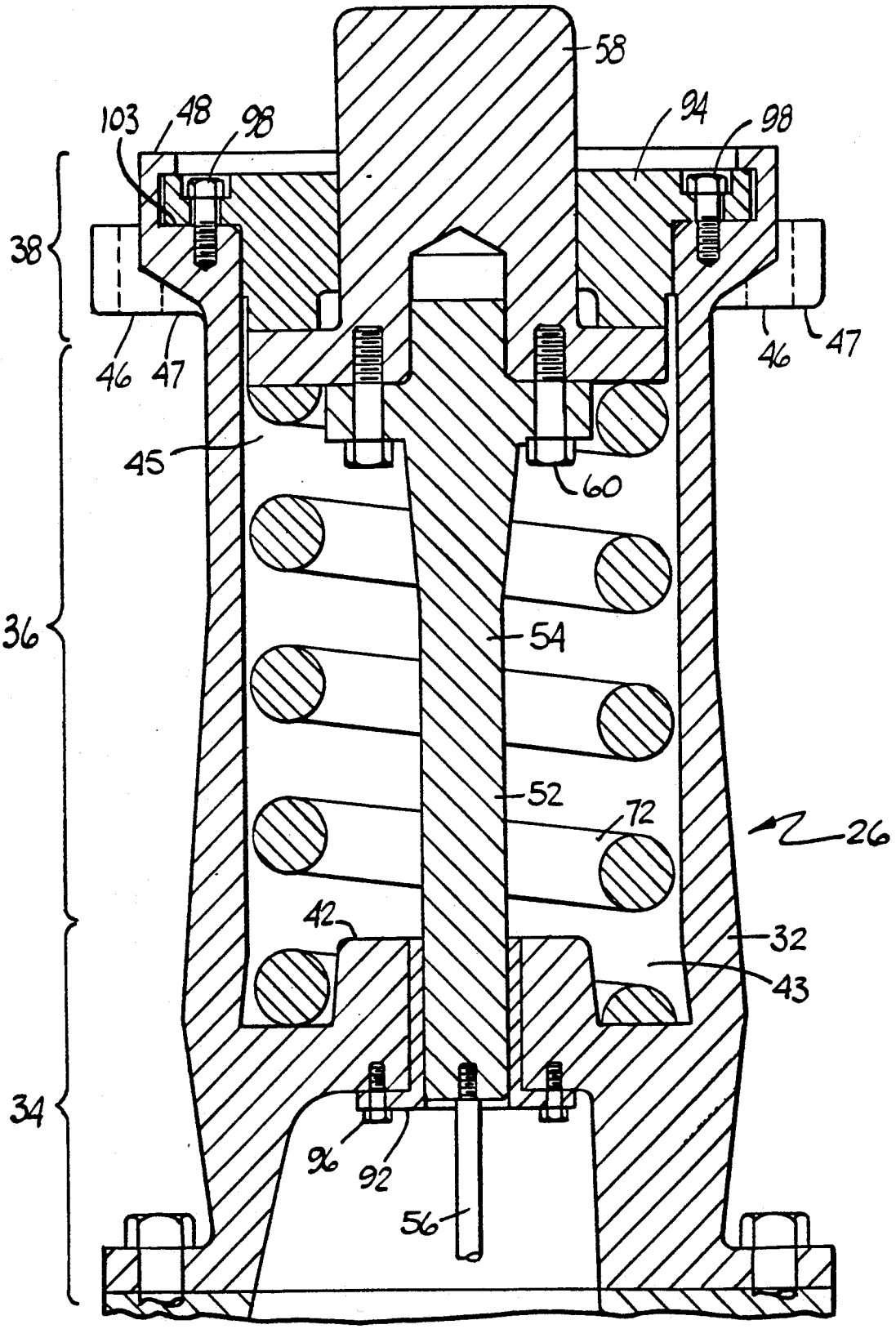
FIG. 2 shows a side sectional view of the cast plunger can structure of the invention.
Figure 3:
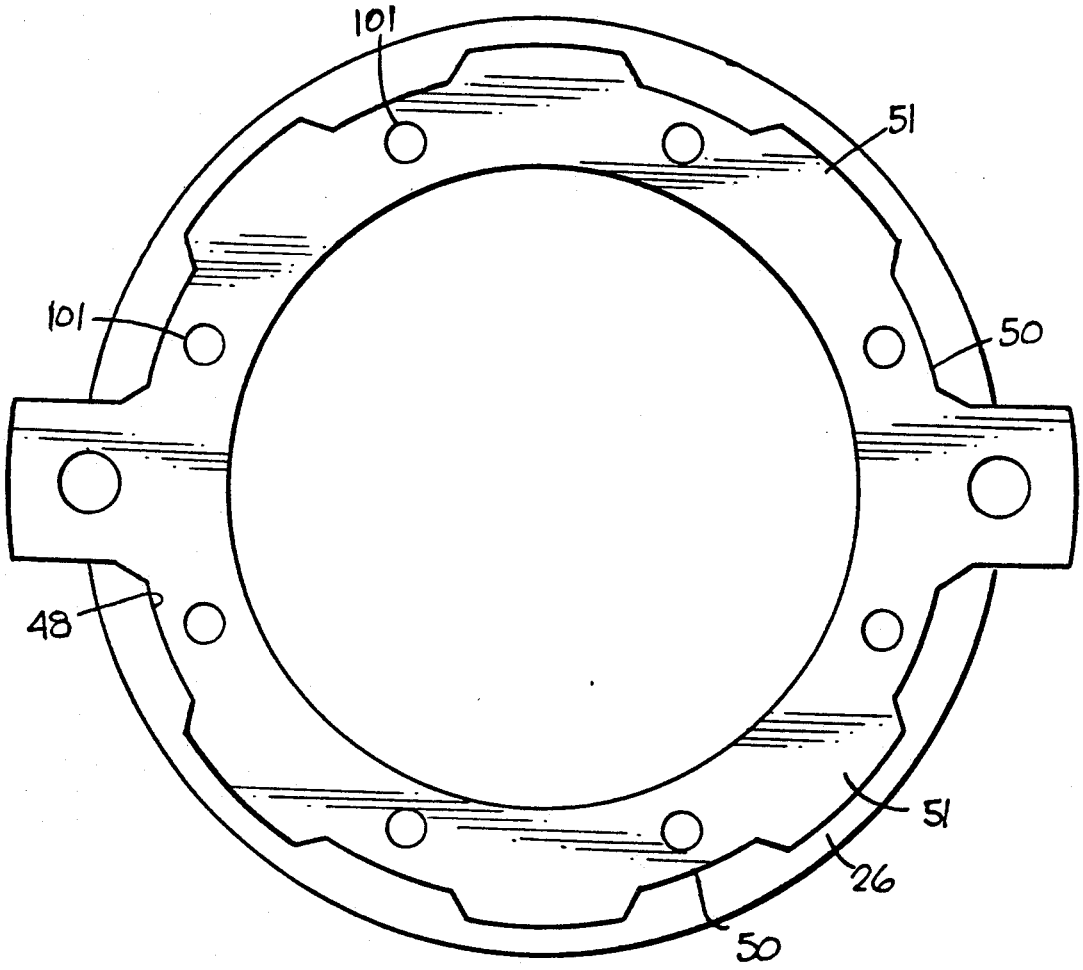
FIG. 3 shows a top view of the cast plunger can structure of FIG. 2 without the plunger or plunger guide.

FIGS. 2 and 3 illustrate the construction and use of the cast plunger can structure 26 and the assemblies housed therein. FIG. 2 shows a sectional side view of the plunger can structure 26 of the present invention. The plunger can structure 26 comprises a cast plunger can 32 which houses the following major components: a plunger assembly 52; a compression spring 72; and a plunger bearing 92 and plunger guide 94.

The cast plunger can 32 and the various assemblies housed within the plunger can structure 26 first will be described with reference to FIG. 2, commencing with the plunger assembly 52, and continuing next to the compression spring 72, then to the plunger bearing assembly (not separately numbered, but including the non-contiguous parts at 92 and 94 of FIG. 2), and, finally, to the cast plunger can 32 itself. Next, the interlocking of the plunger assembly 52 with the cast plunger can 32 will be described with reference to FIG. 3.

With reference to FIG. 2, the plunger assembly 52 housed within the plunger can structure 26 includes a plunger shaft 54 which is dimensioned to extend substantially the entire length of the cast plunger can 32. An indicator rod 56, preferably stainless steel, is threaded into one end of the plunger shaft 54 so as to protrude out of the cast plunger can 32. A plunger tip 58 is affixed to the other end of the plunger shaft 54 by six bolts equidistantly spaced, one of which bolts is shown at 60 in FIG. 2, and the plunger tip 58 protrudes out of the other end of the cast plunger can 32. As shown in FIG. 1, a shim plate 60 may be attached in the conventional manner, by bolts or otherwise, to the outer tip of the plunger tip 58. The shim plate abuts the roller assembly 50, to which it transfers the force of the compression spring 74 housed within the plunger can structure 26.

Still with reference to FIG. 2, the compression spring 72 housed within the plunger can structure 26 is designed to encircle the plunger shaft 54 and is itself encircled by and contained within the cast plunger can 32. A more detailed description of the cooperating cavities and regions of the cast plunger can 32 and plunger assembly 52 will be given in conjunction with the description of the cast plunger can below.

The plunger assembly 52 rides between the plunger bearing 92 which encircles the plunger shaft 54 at one end, and the plunger guide 94 which encircles the plunger tip 58 at the other hand end. The plunger bearing 92 is itself encircled by the cast plunger can 32 to which it is attached by a set of bolts spaced equidistantly around the circumference of the cast plunger can 32, one of which bolts is shown at 96 in FIG. 2. The plunger guide 94 is likewise encircled by and attached to the cast plunger can 32. Because the plunger guide 94 serves not only as a bearing housing for the plunger assembly 52 but also as an openable and interlocking safety cover to the cast plunger can 32, the plunger guide 94 is doubly affixed to the cast plunger can 32 by eight bolts spaced equidistantly around the circumference of said can, one of which bolts is shown at 98 in FIG. 2, and also by eight interlocking lugs spaced equidistantly around the circumference of said can, as will be discussed in more detail below with reference to FIG. 3. The plunger guide 94 is elongated throughout its inner circumference and at the aperture through which the plunger tip 58 protrudes in a dimension suitable to provide longitudinal support to the plunger tip 58 and, consequently, to the plunger assembly 52 as it rides in a reciprocating fashion through the plunger guide 94. Said elongation affords an effective longitudinal bearing surface around 4 ½", more than tripling the corresponding longitudinal bearing surface of existing fabricated plunger cans, which existing surface is only around 1¼". Said elongation of the effective bearing surface of the plunger guide 94 increases the useful life of the plunger tip 58 by improving its stability and lessening the problem of coal packing in the plunger can. This decreases the wash and wobble the plunger tip typically undergoes in existing fabricated plunger cans.

Continuing to refer to FIG. 2, the plunger can 32 comprises the following regions: the can base region 34; the can neck region 36; and the can head region 38. The can base region 34 is elongated inward at the aperture to which the plunger bearing 92 is affixed in a dimension suitable to provide longitudinal support to the plunger assembly 52 and, in particular, the plunger shaft 54, as it rides in reciprocating fashion through the plunger bearing 92. Said elongation is shown at 42 in FIG. 2. The can base region 34 includes, at the interior thereof, a cavity 43 formed by cooperation of (a) the elongation 42, as an inner annular race, (b) the interior wall of the can base region 34 opposite said elongation, as an outer annular race, and (c) the interior floor of said can base, as a seating plate. Said cavity is adapted to seat and hold in place the compression spring 74. The interior wall of the can head region 38, in cooperation with the shoulder formed by the plunger shaft 54 as it abuts the plunger tip 58, forms an annular race and plate 45 adapted to seat and hold in place the other end of the compression spring 74. The can head region 38 contains, on its outer circumference, two opposite and longitudinally aligned mating lugs 47 with stud hole 46. These are adapted to receive the suitable member of the spring compressor system 112, as will be discussed in more detail with reference to FIG. 4, and allow the cans to be used interchangeably rather than requiring a right-hand and left-hand version. Continuing to refer to FIG. 2, the can head region 38 forms a lip 48 at its uppermost extension. The lip 48 contains eight lugs 50, equidistantly spaced, as will be discussed in more detail with reference to FIG. 3.

The cast plunger can 32 is fabricated from a single casting of steel in accordance with processes known in the art to achieve a unitary structure having a tensile strength around 120,000 PSI. This is a more than threefold improvement in strength compared to about 35,000 PSI tensile strength of existing fabricated cans. The embodiment of the cast plunger can 32 shown in FIG. 2 shows a thickening about the can base region 34 where the structure is increased in bulk so as to withstand anticipated wear. Variable and uneven wear on any plunger can mounted in a pulverizing mill is expected due to the sand blasting effect of pulverized coal dust particles suspended in the high velocity air flow throughout the mill (accounting for wear), combined with the unique air flow patterns characteristic of every different mill (accounting for the variability of the wear from mill to mill, and for the unevenness of wear along the length of a plunger can within any one mill). Since said uneven wear is frequently found to result in greater wear on the portion of the plunger can structure 26 at or near the point of its attachment to the clamshell door 70 of the pulverizing mill 10 (FIG. 1), the embodiment of the cast plunger can 32 shown in FIG. 2 demonstrates a counterbalancing thickening at the can base region 34 thereof so as further to improve the durability of said cast plunger can. The cast plunger can 32 of the present invention may be variably thickened, not only at the can base region 34 as shown, but also at the can neck region 36, or the can head region 38, or any combination of said regions. This customizable advantage of a cast plunger can is discussed in more detail below.

Figure 4:
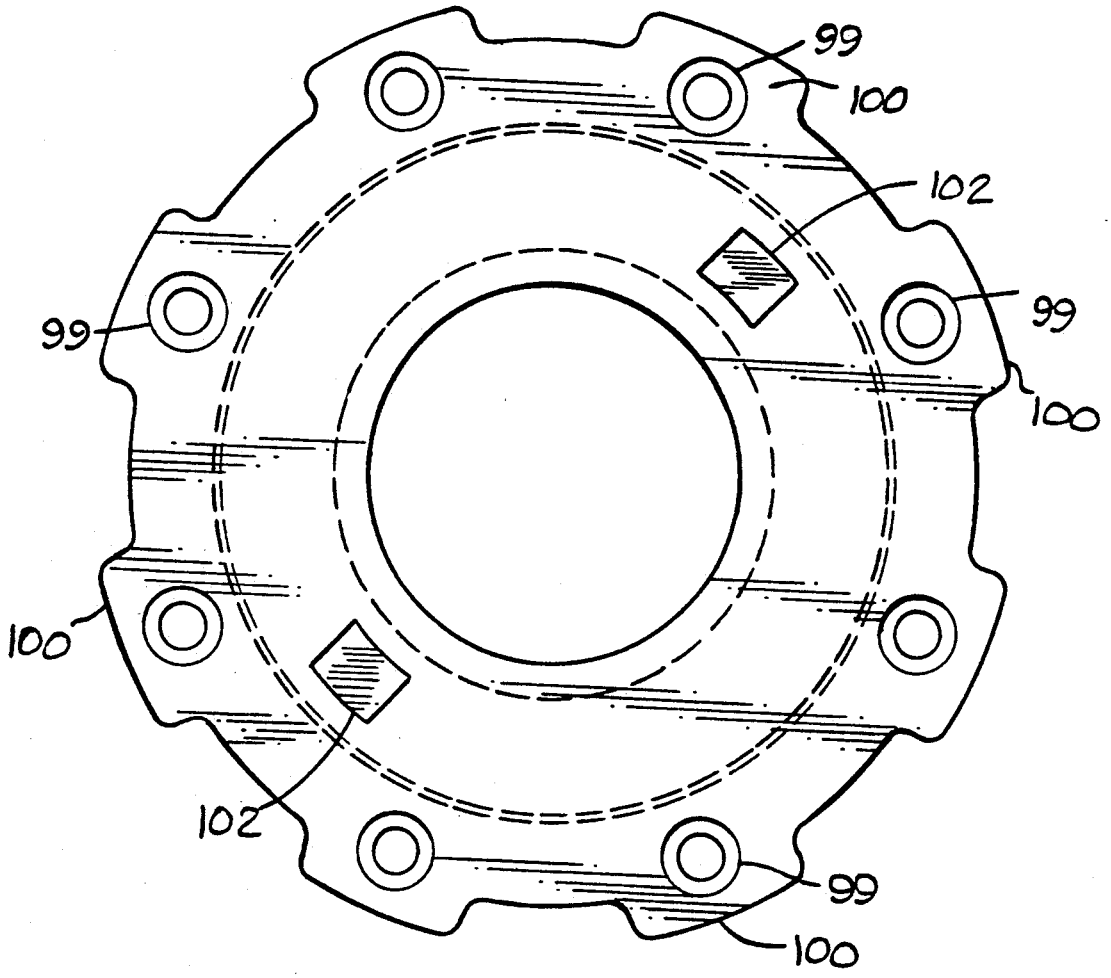
FIG. 4 shows a top view of the plunger guide of FIG. 2.

With reference to FIGS. 3 and 4, the top of the plunger can structure 26 has eight can lugs 51, equidistantly spaced about the inner circumferential aperture opening of said can. The intervals between each of the can lugs 51 form eight can gaps 50. The plunger guide 94 has eight cover lugs 100 equidistantly spaced about the outer circumference of said guide, suitably dimensioned so as to match the eight can gaps 50 of the cast plunger can 32. Threaded bolt holes 99 near the center of each of the plunger guide 94 cover lugs 100 near the center of each of the cast plunger can 32 can lugs 51, mate with threaded bolt holes 101 in the can head region 38 of the cast plunger can 32 so that when (a) the plunger guide 94 is first seated on the cast plunger can 32 with the cover lugs 100 appropriately seated in the matching can gaps 50 of said can, and (b) the plunger guide 94 is then suitably rotated, either clockwise or counter clockwise, each of the eight threaded bolt holes 99 of the cover lugs 100 will align with the corresponding bolt hole 101 of the can lugs 50 and the can head region 38. It should be noted that a shoulder 103 formed at the lip 48 of the cast plunger can 32, as shown in FIG. 2, provides a depression closely beneath the plane of the can lugs 51 in which the cover lugs 100 (FIG. 3) of the plunger guide 94 are able to sit. When said cover lugs 100 are so seated about the circumferential edge of said can lip shoulder 103 the plunger guide 94 can then be rotated. Two vertical lugs 102 are situated opposite one another on the upper surface of the plunger guide 94 to enable said guide to be rotated by the application of any conventional force to said vertical lugs. When situated in the cast plunger can 32 as so described, the plunger guide 94 may be secured thereto by bolts 98 (FIG. 2). The plunger guide 94 is thus doubly secured safely in place, both by bolts 98 and by the retaining action of the can lugs 50 upon the cover lugs 100. This double securing arrangement effected by the cooperation of said bolts and lugs is an improvement over existing mechanisms, which are typically secured by bolts alone. The closure effected by the plunger can structure 26 of this invention results in a much safer assembly.

Figure 5:
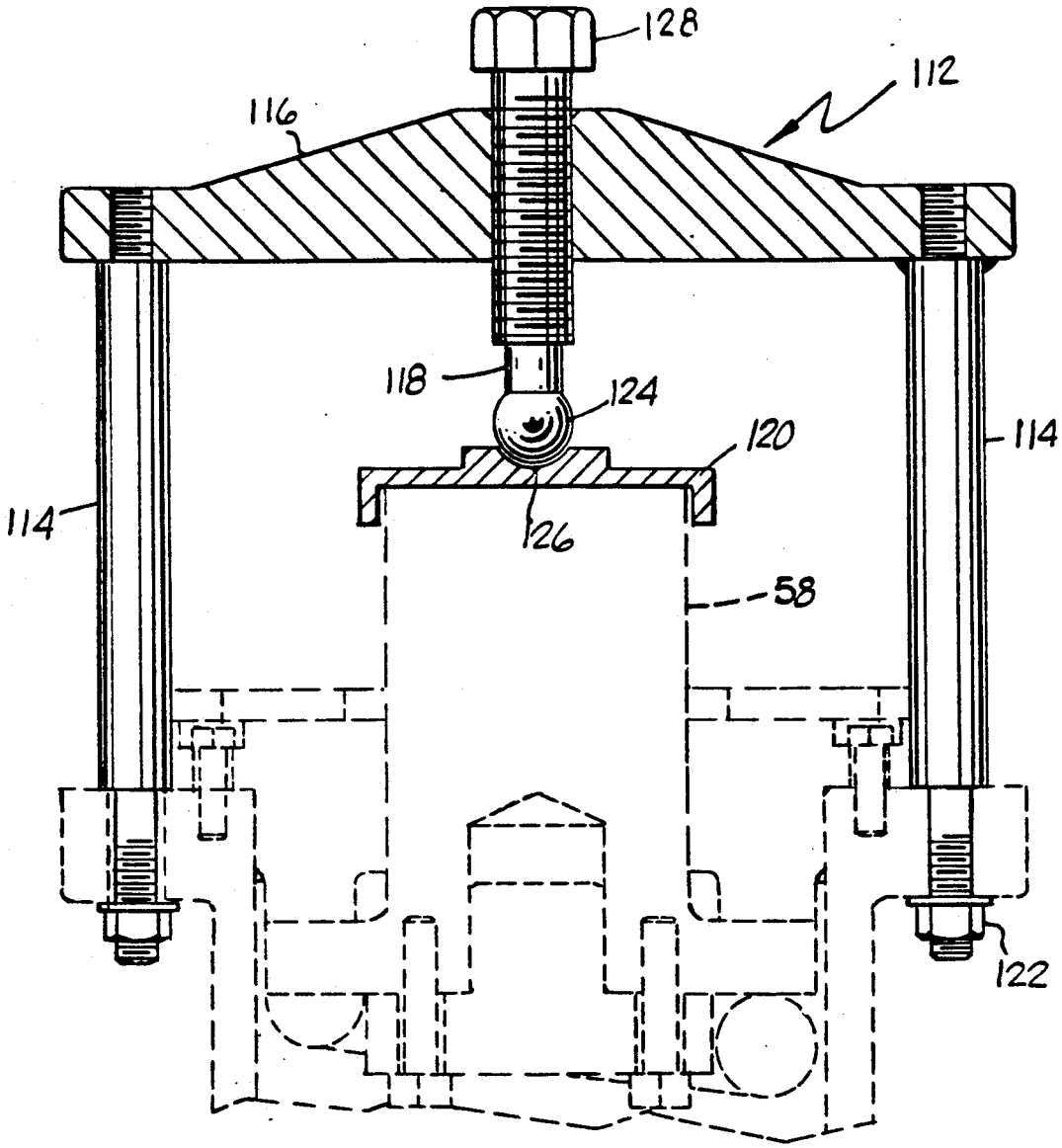
FIG. 5 shows a side view, partially in section, of the plunger can compression spring assembly.
Figure 6:
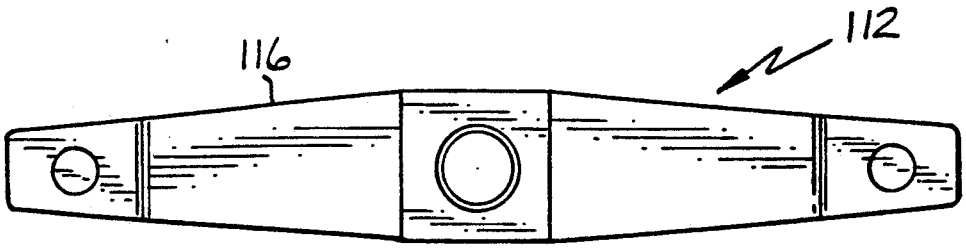
FIG. 6 shows a top view of the plunger can compression spring assembly of FIG. 5.

Having completed the description of the nature of the construction of the plunger can structure 26 of the present invention, the following discussion will describe the mated spring compressor assembly 112 with reference to FIGS. 4 and 5. The spring compressor assembly 112 consists of two support studs 114, a support bar 116, a ball shaft 118, a ball 124, and a positioner 120.

Each of the support studs 114 is threaded and welded to the support bar 116 at one end of said studs. The other end of each support stud 114 is suitably dimensioned, lipped and threaded so as to pass through the stud holes 46 in the mating lugs 44 of the cast plunger can 32 (as seen in FIG. 2), to which said support studs may be detachably affixed by the appropriate nut 122. The support bar 116 is cooperatively dimensioned so that the support studs 114 at either extremity thereof are distanced such that each is plumbed center on the corresponding stud hole 46 of the cast plunger can 32. Said support bar 116 is cut in the center thereof with a threaded hole (shown but not separately numbered in FIG. 4) through which a suitably threaded ball shaft 118 having a lug nut 128 at the end thereof is screwed into place. Once the ball shaft 118 is in place, the ball 124 is affixed thereto by conventional means. The last remaining element of the spring compressor assembly 112 is the positioner 120. Said positioner is a disc-shaped member with a concave bearing surface 126 within which the ball 124 of the ball shaft 118 will sit. The bearing surface 126 is, preferably, greased prior to use. The positioner 120 is suitably lipped on the other side from the ball 124 and dimensioned so as to mate with the plunger tip 58 of the plunger assembly 52 as the female receptacle member of the plunger tip 58/ positioner 120 pair.

Having completed the description of the nature of the construction of the plunger can structure 26 of the present invention, the mated spring compressor assembly 112, and the manner of use said can structure and compressor assembly will now be described.

Referring to FIG. 2, the plunger can structure 26 is loaded with the compression spring 72. The plunger assembly 52, comprising the plunger shaft 54, indicator rod 56 and plunger tip 58, is then loaded into the plunger can structure 26 so as to be encircled by the compression spring 72 (the indicator rod 56 is best installed after the can structure 26 is mounted on the clamshell door 70 of the pulverizing mill 10 (FIG. 1), but is mentioned here for continuity of discussion). The plunger bearing 92 (FIG. 2) is affixed to the cast plunger can 32 so as to provide a journal bearing surface for the plunger shaft 54. Said plunger bearing is shown with its bolted surface approaching the cast plunger can 32 from the exterior thereof, but may also be affixed from the opposite direction so that its bolted surface would approach said can from the interior thereof. Finally, the plunger guide 94 is placed suitably into position on top of and encircling the plunger tip 58 and so aligned with the can lug gaps 51 (FIG. 3) of the cast plunger can 32 as to rest in the lip 48 of said can. The loading of the plunger can structure 26 is completed by operation of the spring compressor assembly 112 (FIG. 4) which is now temporarily attached to the mating lugs 44, of the cast plunger can 32 by the support studs 114 of said compressor assembly and secured in place by the stud nuts 122. Appropriate rotation of the lug nut 128 of the ball shaft 118 of the spring compressor assembly 112 causes the plunger tip 58 to be pushed into the cast plunger can 32, thereby compressing the compression spring 72 (FIG. 2) and releasing the plunger guide 94 from the force otherwise applied against it by the action of said spring on the plunger tip 58. With the spring force thereby released, the plunger guide 94 is rotated into place within the cast plunger can 32, using the vertical lugs 102 (FIG. 4) supplied on the top of said plunger guide 94 or by using a wrench designed for that purpose. After the plunger guide 94 is doubly secured in place (by cooperation of the can lugs 50 and cover lugs 100 previously discussed, and by the bolts 98 previously discussed), the spring compressor assembly may be safely detached from the plunger can structure 26.

The foregoing discussion is descriptive of the use of the indicated members in loading the plunger can structure 26. Unloading is as safely and easily accomplished, following the steps in appropriately inverse order. Loading and unloading may be accomplished both before the plunger can structure 26 is mounted in the pulverizing mill 10 (FIG. 1) and, more importantly, while said can remains mounted. In this last respect, it should be noted that on-site loading and unloading can be effected while the plunger can structure remains mounted by swinging the clamshell door outward and away from the grinding table 18 and then pivoting the roller assembly about its pivot point 25 so as to swing said roller assembly out of the way of the plunger can structure 26. This operation by which access is had to the plunger can structure 26 is familiar to those skilled in the art and need not be described further herein.

One of the important points to appreciate about the design of the compression spring compressor assembly and plunger guide, is that they allow the plunger can to be safely disassembled. As indicated previously, the prior art devices are "bombs" that suddenly and uncontrollably release large forces in the compression spring upon disassembly.

Having loaded the plunger can structure 26 (FIG. 2) as described above and mounted it to the clamshell door 70 by suitable bolts or otherwise, the mode of its use as a mechanical spring compression assembly is well known, and reference may be had to U.S. Pat. 4,706,900 by Prairie et al. for further details. To the extent that the manner of use of the plunger can structure 26 of the present invention differs from the existing structures as typified by the Prairie patent in a manner not readily apparent, it is in the following two particulars.

The plunger can structure 26 includes, as part of the plunger assembly 52 thereof, an indicator rod 56 (FIG. 2) which protrudes through the clamshell door 70 and is cooperatively associated with a diaphragm seal at the point of protrusion. Diaphragm seals are well known, and generally include a mounting plate, a seal retaining ring, a seal inner collar, and a seal outer collar ring, all of which are interengaged through the use of any suitable form of conventional fastening means. The indicator rod 56 provides an immediate visual indication of the actual travel of the plunger assembly 52 within the plunger can structure 26. As said plunger assembly 52 rides in reciprocating motion within said can structure 26, the indicator rod 56 affords an easy and direct reading of the plunger action otherwise contained within structures not open to view during ordinary operation. It should be noted that the indicator rod 56 is a detachable member, best suited for use in a pulverizing mill 10 (FIG. 1) in which the roller assemblies 50 and associated plunger can assemblies 26 are stationery and in which the grinding table 18 rotates.

The second particular aspect of the use of the plunger can structure 26 of the present invention has to do with the shim plate 60. In the preferred embodiment, the compression tension is set, within the appropriate tolerances, by the mill operator's specifying the desired tension to the supplier of the compression spring 72 who then furnishes the appropriate spring. Some adjustment to the preloaded tension is, from time to time, desirable. In the preferred embodiment of the present invention, such adjustment is effected by replacement of the shim plate 60 with a thinner or thicker plate. A thinner shim plate 60 reduces the compression applied to the roller assembly 22, while a thicker shim plate 60 has the opposite effect.

What is claimed is:

1. A plunger can assembly for a pulverizing mill, comprising: a hollow cylindrical can with an open end; a plunger guide mounted to the can to close the open end; a plunger assembly recipically mounted in the plunger guide; a compression spring mounted in the can and applying a force urging the plunger assembly and the plunger guide away from the can; a set of can lugs spaced around the can and a set of plunger guide lugs spaced around the plunger guide rotationally engageable and disengageable with the can lugs to lock the plunger guide onto the can and resist the force of the compression spring; and safety means to hold the plunger assembly in the can when disengaging the lugs, said plunger can, a support bar attached to and connecting the other end of said studs, and a positioning shaft extending through said support bar to bear against and hold in place the plunger assembly.

2. The cast plunger can assembly of claim 1, wherein the positioning shaft is threaded through the support bar and extends axially so that the bearing force of the positioning shaft against the plunger assembly is adjustable by rotatably threading the positioning shaft through the support bar.

3. The cast plunger can assembly of claim 2, wherein the safety means includes a positioner attached to the end of the positioning shaft that bears force against the plunger assembly, the positioner and positioning shaft being attached to one another by a ball and socket.

* * * * *